United States Patent [19]

Reist

[11] Patent Number: 4,886,260

[45] Date of Patent: Dec. 12, 1989

[54] METHOD AND APPARATUS FOR RECEIVING FOLDED PRINTED PRODUCTS FROM PRINTING MACHINES OR THE LIKE

[75] Inventor: Walter Reist, Hinwil, Switzerland

[73] Assignee: Ferag AG, Hinwil, Switzerland

[21] Appl. No.: 109,365

[22] Filed: Oct. 19, 1987

[30] Foreign Application Priority Data

Oct. 22, 1986 [CH] Switzerland ..... 04 210/86

[51] Int. Cl.[4] ..... B65H 39/08

[52] U.S. Cl. ..... 270/60; 271/189; 271/315; 270/47

[58] Field of Search ..... 270/54, 55, 56, 57, 270/58, 59, 19, 47–48, 60; 271/187, 271, 308, 315, 314

[56] References Cited

U.S. PATENT DOCUMENTS

| | | | |
|---|---|---|---|
| 4,487,408 | 12/1984 | Fischer | 271/133 |
| 4,501,418 | 2/1985 | Ariga et al. | 271/187 |
| 4,537,390 | 8/1985 | Kaimco | 270/53 |
| 4,729,554 | 3/1988 | Honegger | 270/55 |

FOREIGN PATENT DOCUMENTS

| | | | |
|---|---|---|---|
| 0067399 | 12/1982 | European Pat. Off. . | |
| 3404459 | 8/1985 | Fed. Rep. of Germany . | |
| 3521471 | 4/1986 | Fed. Rep. of Germany | 270/53 |
| 2387181 | 11/1978 | France . | |
| 2549025 | 1/1985 | France . | |
| 580023 | 9/1976 | Switzerland | 270/54 |

*Primary Examiner*—Robert E. Garrett
*Assistant Examiner*—Therese M. Newholm
*Attorney, Agent, or Firm*—Fleit, Jacobson, Cohn, Price, Holman & Stern

[57] ABSTRACT

A conveyor device which is equipped with grippers secured to a chain structure is arranged beneath a rotary bucket or fan wheel of a printing machine, typically a printing press. These grippers engage trailing edges of the printed products which still abut against at least one stripper wheel. The printed products are thus fixedly retained before departing from the rotary bucket or fan wheel. By means of a revolvingly driven belt, which engages at the trailing edges of the printed products, these printed products are displaced or stuffed into the associated compartment or bucket of the rotary bucket or fan wheel prior to their engagement by the grippers. The printed products thus assume a defined position within the compartments or buckets, thus rendering possible the subsequent positionally-correct removal of the printed products from the compartments or buckets of the rotary bucket or fan wheel.

33 Claims, 5 Drawing Sheets

1
2
2a
4
4a
4b
5
6
7
7a
8
10
11
14
15
16
17
18
24
25
26
28
29
30
31
31a
32
33
34
35,43
36
37
37'
38
39
40
40a
42
3
A
B
C
D
E
F
G
S
a
a1
V1
V2
V3
V4

8
10
7
21
20
18
22
24
4
26
30
31a
31
IV
IV
24
18
20
14
9
21
22
12
7

D
26
4
7a
21
4b
19
18
21a
22
22a
20
23
12
24
14
20a
7
9

METHOD AND APPARATUS FOR RECEIVING FOLDED PRINTED PRODUCTS FROM PRINTING MACHINES OR THE LIKE

BACKGROUND OF THE INVENTION

The present invention relates to a new and improved method of, and apparatus for, receiving or taking-over printed products, especially folded printed products, from a revolvingly driven bucket or fan wheel of a printing machine, typically a printing press.

Generally speaking, the method for receiving printed products, especially folded printed products, from a revolvingly driven or rotary bucket or fan wheel of a printing machine, entails fixedly retaining or holding each of the printed products at an edge thereof during their departure out of the compartments or buckets of a rotary bucket or fan wheel and outfeeding such printed products in a shingled or imbricated superimposed product formation.

The apparatus for receiving or taking over printed products, especially folded printed products, from a revolvingly driven or rotary bucket or fan wheel of a printing machine, comprises a conveyor device which is equipped with grippers for the retention of an edge of each associated printed product during their departure or emergence out of the compartments or buckets of the rotary bucket or fan wheel.

It is well known in this technology to insert or stuff into the compartments or buckets of a rotary bucket or fan wheel the printed products departing from the folding apparatus of printing machines. The printed products are hen removed from these compartments or buckets and placed in a shingled array or imbricated product formation upon distributor belts or bands. For the subsequent processing of the printed products, it is of importance that the imbrication spacing or pitch of the printed products is uniform or regular within the laid-out or distributed imbricated product formation.

In order to attain this objective it has already been proposed in Swiss patent No. 626,830, granted Dec. 15, 1981, to engage the printed products at their edges bearing against the floor or base of the compartments or buckets of the rotary bucket or fan wheel before the products depart out of such compartments or buckets. The engagement of such product edges is accomplished by controlled grippers which act upon the leading edges of the products. The printed products which are fixedly retained by the grippers are withdrawn from the compartments or buckets of the rotary bucket or fan wheel and deposited in a shingled array or imbricated product formation upon an outfeeder or delivery conveyor. To ensure that the edges of the printed products which are to be engaged by the grippers positively come to lie within the confines of the grippers, the circumferential velocity of the grippers is smaller than the circumferential velocity of the floor or base of the compartments or buckets of the rotary bucket or fan wheel. Thus, the grippers also assume the role of a conventionally present stripper element, such as a belt, wheel or the like, at which the printed products impact with their leading edges and in this manner can be displaced out of the rotary bucket or fan wheel.

The printed products which are fixedly retained-by the grippers, during sliding out of the rotary bucket or fan wheel, remain in that position which they assumed at the point in time of reception by the grippers in the associated compartment or bucket of the rotary bucket or fan wheel. Nonetheless irregularities in the imbrication spacing or pitch of the shingled or imbricated product formation can arise if the printed products, at the moment of time of engagement by the grippers, do not correctly bear at the floor or base of the associated compartment or bucket. Additionally, during transfer of the printed products from the grippers to the outfeeder or delivery conveyor arranged therebelow there can arise positional displacement or shifting between successive printed products. This can result in irregularities in the imbrication spacing or pitch of the shingled or imbricated product formation.

Furthermore, from the European Published patent application No. 0,179,992, published May 7, 1986, it is known to fixedly clamp printed products infed from above or overhead approximately tangentially to a rotary bucket or fan wheel, at the leading product edges between the walls of the compartments or buckets of the rotary bucket or fan wheel and a revolving belt. In this way it is possible to fixedly retain the printed products during the rotational movement of the rotary bucket or fan wheel. At the lowest point the leading edges of the printed products are then again released and these printed products are allowed to drop onto a conveyor belt in order to form a product stack. Also this prior art solution is afflicted with the drawback that a regular or uniform imbrication spacing or pitch cannot be realized when the printed products are unable to completely drop down into contact with the floor or base of the compartments or buckets of the rotary bucket or fan wheel before they are fixedly retained in place. However, with this prior art equipment such is not of any particular significance when it is recalled, as explained above, that the printed products are placed into stacks and are not further processed in a shingled or imbricated product formation or array.

Furthermore, from U.S. Pat. No. 4,565,363, granted Jan. 21, 1986, it is known to place the leading edges of printed products located in the compartments or buckets of a rotary bucket or fan wheel, during the rotational movement of such rotary bucket or fan wheel, into contact or impacting relationship with cams or stops or the like which are revolvingly driven at a lower velocity in relation to the velocity of movement of the printed products. The printed products ejected by the cams or stops out of the compartments or buckets of the rotary bucket or fan wheel are deposited in a shingled array or imbricated product formation upon a conveyor belt. Due to the impact of the printed products against the cams or stops these printed products are indeed aligned, however during the free fall of the printed products onto the conveyor belt and upon impingement of the printed products at the conveyor belt the printed products can shift in their mutual position and this, in turn, can lead to irregular imbrication spacings or pitches.

In the apparatus disclosed in German patent No. 3,123,406, published Dec. 12, 1985, corresponding to European Published patent application No. 0,067,399, published Dec. 22, 1982 and U.S. Pat. No. 4,487,408, granted Dec. 11, 1984, the printed products are likewise aligned by revolvingly driven cams or dogs which, however, engage at the rear trailing edges of the printed products as soon as these printed products are completely released from the rotary bucket or fan wheel. At the point of time of engagement of the cams or dogs at the rear edges of the printed products the latter, at the region of the leading edges thereof, already are located upon the preceding printed product which is entrained by the distributor belt. Due to the frictional forces prevailing between the products which mutually bear upon one another the cams or dogs can only change to a limited extent the engaged printed product as concerns its position. This means that considerable irregularities in the imbrication spacing or pitch cannot be completely compensated. Such irregularities can arise, for instance, when the printed products do not come to lie in the correct position in the compartments or buckets of the rotary bucket or fan wheel or if the printed products experience a positional change or spatial shift during the free fall of such printed products out of the compartments or buckets onto the distributor belt.

SUMMARY OF THE INVENTION

Therefore, with the foregoing in mind it is a primary-object of the present invention to provide a new and improved method of, and apparatus for, receiving printed products, especially folded printed products, from printing machines, typically printing presses, in a manner not afflicted with the aforementioned drawbacks and limitations of the prior art.

Another and more specific object of the present invention is directed to a new and improved method of, and apparatus for, receiving printed products, especially folded printed products, outputted by a printing machine, wherein it is possible to form from the printed products received from a rotary bucket or fan wheel of the printing machine, and then in an extremely simple manner, even when encountering high operating or working speeds, a shingled or imbricated product formation or array possessing extremely uniform or regular imbrication spacing or pitch of the printed products.

Still a further significant object of the present invention is directed to a new and improved method of, and apparatus for, receiving products, especially printed products, and more particularly folded printed products, from a revolvingly drive bucket or fan wheel in a manner such that there can be extremely reliably formed an imbricated product formation having a substantially regular imbrication spacing or pitch.

Still a further noteworthy object of the present invention aims at a new and improved method of, and apparatus for, receiving products, especially printed products, from a rotary bucket or fan wheel in a manner such that the received products are reliably and controllably deposited in a shingled array or imbricated product formation having an extremely uniform or regular imbrication spacing or pitch and which is advantageously realized by facilities arranged externally of the buckets or compartments of the rotary bucket or fan wheel.

Yet a further significant object of the present invention is directed to a new and improved construction of apparatus for reliably and positively shingling or imbricating products received from a rotary bucket or fan wheel so as to possess a substantially uniform or regular imbrication pitch or spacing, which apparatus is relatively simple in construction and design, quite economical to manufacture, extremely reliable in operation, and requires a minimum of maintenance and servicing.

Now in order to implement these and still further objects of the invention, which will become more readily apparent as the description proceeds, the method for receiving printed products, especially folded printed products, from a revolvingly driven or rotary bucket or fan wheel of a printing machine or the like, contemplates fixedly holding or retaining the printed products at their trailing edges viewed with respect to the direction of rotation of the revolvingly driven or rotary bucket or fan wheel.

As already mentioned previously, the present invention is not only concerned with the aforementioned method aspects, but also is directed to a new and improved construction of apparatus for receiving printed products, especially folded printed products, from a revolvingly driven or rotary bucket or fan wheel of a printing machine, typically a printing press, wherein the grippers or gripper elements engage or act upon the printed products at their trailing edges as viewed with respect to the direction of rotation of the revolvingly driven or rotary bucket or fan wheel.

The invention is based, among other things, upon the recognition that it is important to fixedly hold or retain the printed products as soon as possible, in any event prior to the complete departure of the printed products out of the compartments or buckets of the rotary bucket or fan wheel and to thus fix the printed products in their mutual position or posture for the subsequent formation of a shingled or imbricated product formation.

The engagement or grasping of the trailing edges of the printed products, as contemplated by the present invention, enables the realization of the strived for early or incipient retention of the printed products through the use of relatively simple expedients or means, since for this purpose it is not necessary to act upon the products at a location within the compartments or buckets of the rotary bucket or fan wheel. At the point in time or moment that there is engaged the trailing edge of each printed product the corresponding printed product, at the region of its leading product edge, is still located within the confines of the related compartment or bucket of the rotary bucket or fan wheel and does not yet lie upon or only at the region of the trailing edge and then very loosely upon the preceding or leading printed product. Consequently, the printed products, prior to the engagement of the trailing edges thereof, cannot experience an undesired appreciable positional change due to frictional entrainment by the preceding printed product.

In order to place the trailing edge of each printed product with certainty into the operative or effective region of the grippers, there is preferably provided an acceleration device or arrangement which engages the trailing edge of a printed product at the start of the ejection thereof out of the associated compartment or bucket of the rotary bucket or fan wheel and directs or propels such engaged trailing product edge downwardly into the operative or effective region of each associated gripper or gripper element.

In order to ensure that there is even possible a positionally-correct reception of the printed products from the rotary bucket or fan wheel, the printed products must already be correctly disposed or positioned in the compartments or buckets of the rotary bucket or fan wheel. To ensure that this condition is fulfilled, it can be advantageous to provide an alignment device or arrangement which, prior to the engagement of the printed products by the grippers, engages at the trailing edges of the printed products and displace or stuffs or inserts each printed product into the associated compartment or bucket of the rotary bucket or fan wheel, and specifically, preferably until such printed product comes into contact with the floor or base of the relevant compartment or bucket.

Additionally, it is advantageous to provide a support device for the printed products. This support device extends in the conveying or conveyance direction of the conveyor device and has a lesser width than that of the printed products. Upon deposition or placement of the printed products upon the support device there cannot form any disturbing air cushions between the support device and the printed products which otherwise might delay and render more difficult the positionally-correct superposition of the printed products.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
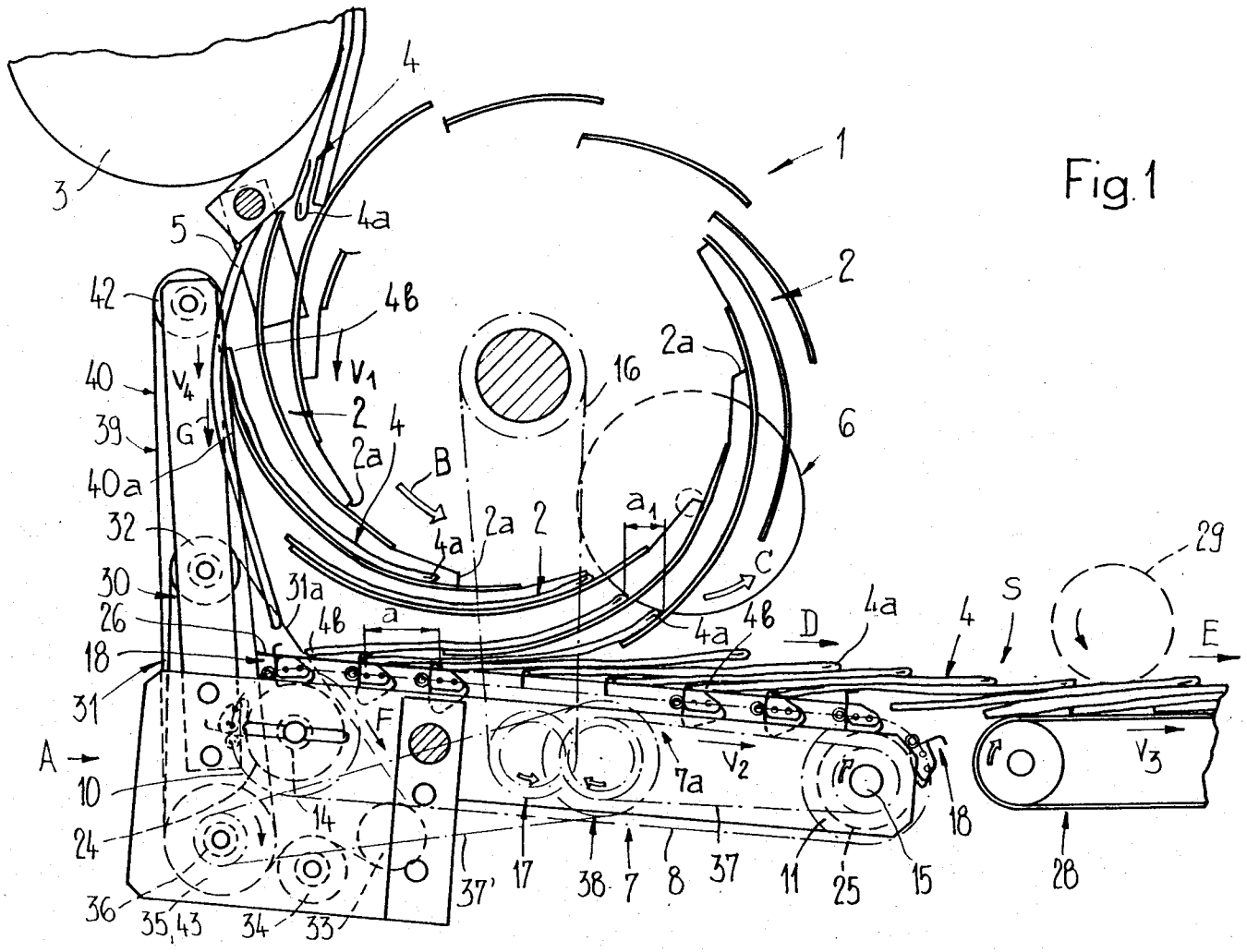
FIG. 1 illustrates in schematic side view a first exemplary embodiment of an apparatus for the reception or take-over and outfeeding or delivery of printed products ejected from a rotationally driven or rotary bucket or fan wheel of a printing machine.

Describing now the drawings, it is to be understood that only enough of the construction of the apparatus for the reception or take-over of products, preferably printed products and, in particular, folded printed products, from a revolvingly driven or rotary bucket: or fan wheel of a printing machine and the therewith related structure thereof, have been conveniently depicted in the drawings to simplify the illustration thereof and as needed for those skilled in the art to readily understand the underlying principles and concepts of the present development. Turning attention now specifically to FIG. 1, there is depicted purely schematically therein the revolvingly driven or rotary bucket or fan wheel 1, sometimes also referred to in the art as a distributor wheel, of a printing machine. This rotary bucket or fan wheel 1 contains a plurality of compartments or buckets 2 which are open at the circumference or periphery of the rotary bucket or fan wheel. The floor or base of each of the compartments or buckets 2 has been conveniently designated by reference character 2*a*. The rotary bucket or fan wheel 1 is appropriately revolvingly driven in conventional manner sc as to rotate in the direction of the arrow B at the circumferential velocity $V_1$. Arranged upstream or forwardly of the rotary bucket wheel 1 is a not particularly illustrated but conventional folding apparatus from which the departing folded printed products 4 fall by means of a guide roll or roller 3 or equivalent structure into the compartments or buckets 2 of the rotary bucket wheel 1.

As will be recognized by further inspecting FIG. 1, the printed products 4 depart from the guide roll or roller 3 with their fold edge 4*a* leading. This fold edge 4*a*, viewed with respect to the direction of rotation B of the rotary bucket wheel 1, thus constitutes the leading product edge. Following the guide roll or roller 3 there is provided a guide member or guide 5, for instance formed of sheet metal or metal plating, which extends in the direction of the circumference of the rotary bucket wheel 1. By means of this guide member 5 the trailing edges 4*b* of the printed products 4 are guided during the revolving motion of the rotary bucket wheel 1. To eject the printed products 4 out of the compartments or buckets 2 there is provided a stripper wheel 6, if desired a plurality of such stripper wheels also can be provided. Each such stripper wheel 6 rotates in the direction of the arrow C. The printed products 4 impact at such stripper wheel 6 or plurality of such stripper wheels 6 at their leading edges 4*a* and thus, during further rotation of the rotary bucket wheel 1, are pushed out of or ejected from the compartments or buckets 2. Instead of employing a stripper wheel or wheels 6 there also can be used another suitable stripper element or elements, such as for instance an endless belt or band, a bracket or the like.

At this juncture it is mentioned that the rotary bucket or fan wheel 1, the stripper wheel or wheels 6 and the folding device or apparatus are of conventional construction and also the mode of operation thereof are well known in this technology so that no further discussion thereof is here believed to be necessary or warranted, particularly since the same are not important for understanding the underlying principles and concepts of the present development.

Continuing, it will be observed, again by referring to FIG. 1, that beneath the revolvingly driven or rotary bucket wheel 1 there is arranged a conveyor or conveying device 7, the conveying or conveyance direction of which has been conveniently designated by reference character D and whose conveying or conveyance velocity by reference character $V_2$. The conveying direction D is the same as or in the same sense as the direction of rotation B of the rotary bucket wheel 1. As will be particularly evident by inspecting FIGS. 2 and 3, the conveyor or conveying device 7 possesses two endless chains or chain members 8 and 9 defining traction elements. These chains or chain members 8 and 9 are guided so as to be substantially mutually parallel and in spaced relationship with respect to one another. Moreover, these chains or chain members 8 and 9 are guided about the deflection wheels or sprockets 10 and 11 and 12 and 13, respectively. The deflection wheels or sprockets 10 and 12 are rotatably mounted upon a rotatable shaft or shaft member 14, whereas the other deflection wheels or sprockets 11 and 13 are secured to a rotatable shaft or shaft member 15, which are driven by chains 16 and 16' as well as a gearing transmission or gear box 17 by means of the rotary bucket wheel 1, as will be apparent from the showing of FIGS. 1 and 2.

At the chains 8 and 9 there are secured at a uniform spacing or pitch the grippers or gripper elements 18 which move along a closed or endless path of travel. Each of these grippers 18 is provided with a movable gripper tongue or gripper portion which is designated by reference character 19. Each of the gripper tongues 19 or equivalent structure form part of an associated bracket or strap member 20 or equivalent structure which is formed from a multiply folded strip formed of a suitable resilient or spring-elastic material, and this arrangement has been particularly well depicted in FIG. 4. The brackets or strap members 20 are each secured to a related holder body or holder 21 which is arranged at associated bolts or bolt members 22 or equivalent structure which are connected with the chains 8 or 9, as the case may be, and which protrude laterally away therefrom, as particularly well shown in FIG. 3. The holder bodies or holders 21 are each provided with a surface 21*a* serving as a counter support or counter surface for the gripper tongues or gripper portions 19. As will be seen from FIG. 4, at the chains or chain members 8 and 9 there are mounted further support rolls or rollers 23 at which bears the one leg 22*a* of the associated or neighboring spring bracket or strap member 20.

In order to open the grippers or gripper elements 18, in other words, for raising the gripper tongues 19 away from the counter surfaces 21*a*, there are provided opening or actuation elements, here shown as opening cams 24 and 25 (FIG. 2) or equivalent structure, which, as shown, are coaxially arranged with respect to the associated deflection wheels or sprockets 10, 12 and 11, 13, respectively. These opening cams 24 and 25 are here formed by the hubs or hub portions 50 of the neighboring deflection wheels or sprockets 10, 12 and 11, 13, respectively, as again will be evident from FIG. 2. Upon travel of the chains or chain members 8 and 9 onto the deflection wheels or sprockets 10, 11 and 12, 13, respectively, the brackets or strap members 20 together with the related portion designated by reference character 20*a* travel onto the associated opening cams 24 and 25. As a result, these brackets or strap members 20 are bent in a direction away from the opening cams 24 and 25, so that the gripper tongues 19 or the like are raised from the counter surfaces 21*a*, as such has been depicted in FIG. 4. As soon as the brackets or strap members 20 again travel off of the opening cams 24 and 25, these brackets 20 return back into their starting or initial position owing to their resilient or spring-elastic properties, so that the gripper tongues 19 again bear against the counter surfaces 21*a* and press each seized printed product 4 firmly against such associated counter surface 21*a*.

At the region of the deflection wheels or sprockets 10 and 12, that is to say, at the start of the conveying-active run or path 7*a* of the conveyor or conveying device 7 there is arranged a support device 26 for the printed products 4 and which is located between both of the chains 8 and 9. This support device or support 26 may be formed of, for instance, sheet metal or metal plating. Such support device 26 advantageously has a lesser width than that of the printed products 4.

As also will be apparent from the showing of FIG. 1, an outfeeder or delivery conveyor 28 or equivalent structure operatively merges or is associated with the conveyor device 7 downstream thereof and possesses the same conveying direction E as the conveying direction D of the conveyor device 7. This outfeeder or delivery conveyor 28 preferably possesses a conveying velocity $V_3$ which is slightly greater than the conveying velocity $V_2$ of the conveyor device 7. In order to augment the conveying action of the outfeeder or delivery conveyor 28 there can be provided a conveyor roll 29 or equivalent structure which, as shown, is disposed above the outfeeder or delivery conveyor 28.

Figure 2:
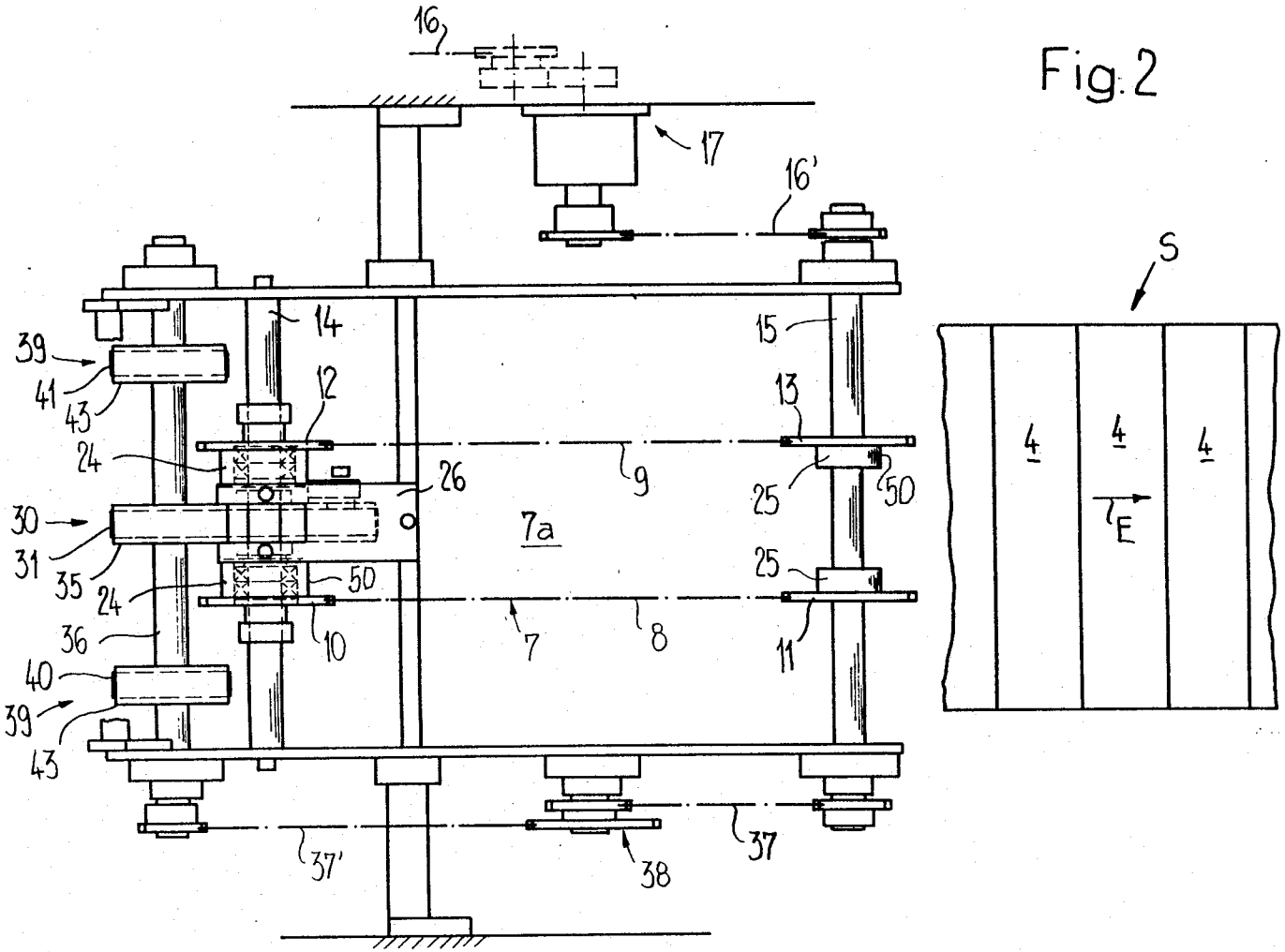
FIG. 2 is a top plan view of the printed product receiving device depicted in FIG. 1.
Figure 3:
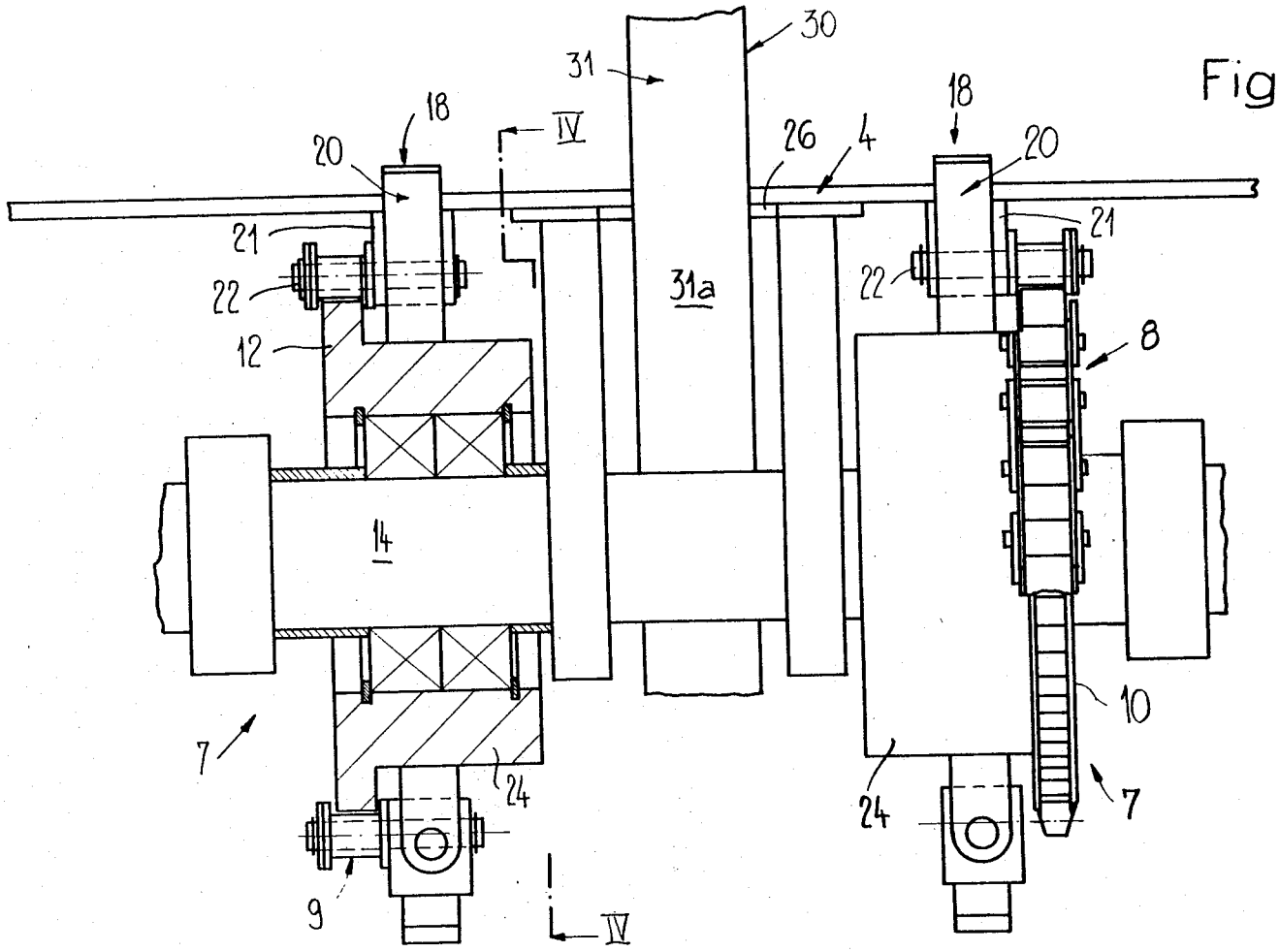
FIG. 3 illustrates the product receiving or take-over device depicted in FIG. 1, partially in sectional view and looking in the direction of the arrow A of FIG. 1.
Figure 4:
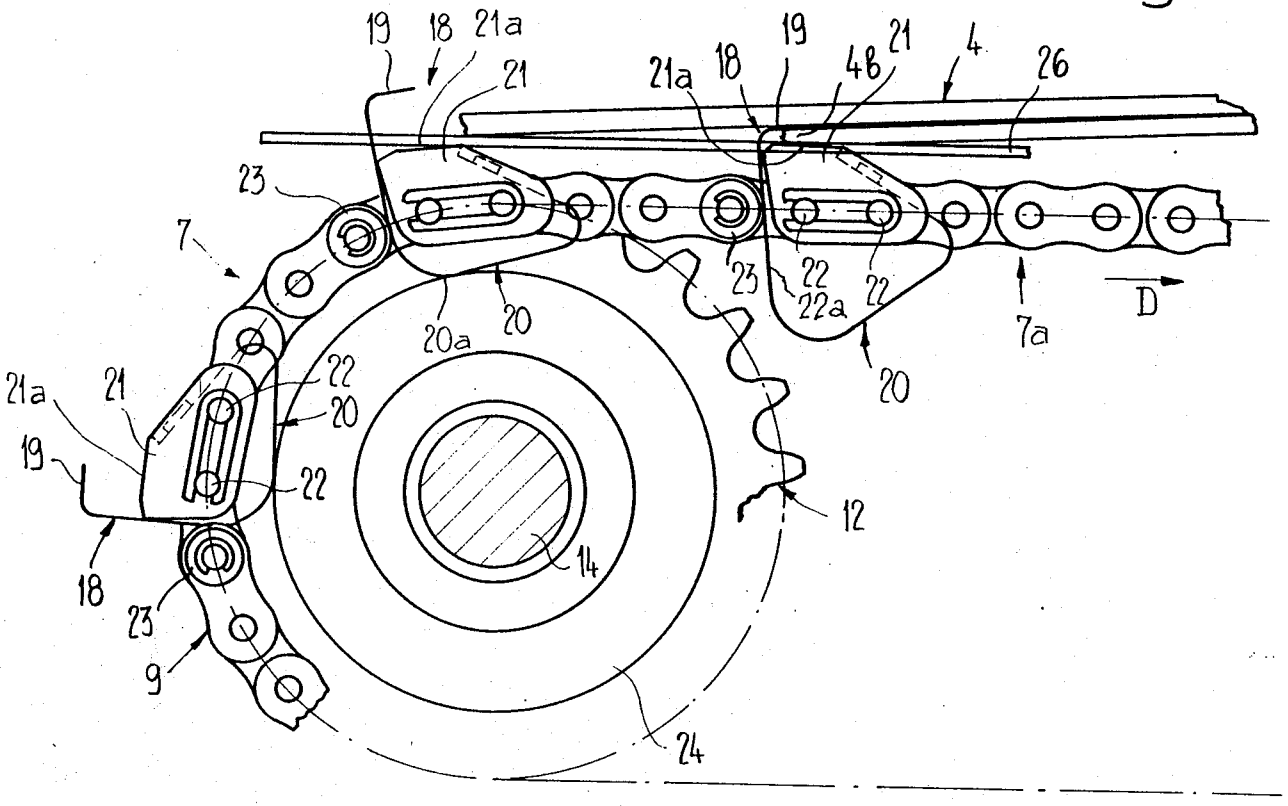
FIG. 4 is a cross-sectional view of the product receiving or take-over device depicted in FIG. 3, taken substantially along the line IV—IV thereof.

It will also be observed from the showing of FIGS. 1 to 3 that at the region of the deflection wheels or sprockets 10 and 12 and intermediate the same there is provided an acceleration device or arrangement 30. Such product acceleration device or arrangement 30 is here shown constituted by an endless band or belt 31 which is driven to revolve in the direction of the arrow F. As will be seen from FIG. 1, this band or belt 31 is guided over the deflection rolls 32, 33, 34 and 35. The deflection roll 35 is seated upon a shaft or shaft member 36 which is driven, as shown in FIGS. 1 and 2, by the shaft 15 via the chains 37 and 37′ and a step-up gearing arrangement or structure 38. The conveying-active run 31*a* of the band or belt 31, and which is located between the deflection rolls or rollers 32 and 33, extends transversely with respect to the conveying direction D of the conveyor device 7 and is inclined with respect to the vertical. As will be evident from FIG. 1, the sheet metal guide member or guide 5 or the like extends up to this conveying-active run or path 31*a* of the band or belt 31.

Furthermore, apart from the acceleration device or arrangement 30 there is also provided an aligning or alignment device or arrangement 39 which comprises two endless bands or belts 40 and 41 which are appropriately revolvingly driven in the direction of the arrow G. These bands or belts 40 and 41 are driven at a velocity $V_4$ which is greater than the revolving or rotational velocity $V_1$ of the rotary bucket or fan wheel 1. Both of the bands or belts 40 and 41 are guided over deflection rolls 42 and 43, wherein the deflection rolls 43 are seated upon the shaft or shaft member 36. As will be also evident from FIG. 2, the bands or belts 40 and 41 are arranged at a spacing or in spaced relationship from the band or belt 31 of the acceleration device 30. The conveying-active run or path 40*a* of each of the bands or belts 40 and 41 extends approximately tangentially with regard to the rotary bucket or fan wheel 1. Furthermore, the effective or active region of each such conveying-active run or path 40*a* of the belts or bands 40 and 41 is located above the effective or active region of the conveying-active run or path 31*a* of the belt or band 31, as will be recognized by inspecting FIG. 1.

The mode of operation of the described apparatus will now be considered and is as follows:

The printed products 4 arriving from the conventional folding apparatus drop into the compartments or buckets 2 of the rotary bucket or fan wheel 1. During the revolving motion of the rotary bucket or fan wheel 1 the trailing edges 4*b* of the printed products 4 are guided along the sheet metal guide member 5. During the sliding of such trailing edges 4*b* along the sheet metal guide member 5 these trailing edges 4*b* come to bear at the belts or bands 40 and 41 of the aligning or alignment device 39. Now if the printed product 4 which bears against the belts or bands 40 and 41 is not correctly dispositioned in the related department 2, in other words, if it does not completely bear with its leading product edge 4*a* at the floor or base 2*a* of the related compartment or bucket 2, then the printed product 4 is displaced or stuffed by the action of the belts or bands 40 and 41 into the corresponding compartment or bucket 2 until it assumes the correct position or posture within such compartment or bucket 2. Due to the action of the belts or bands 40 and 41 of the aligning device 39 there is thus ensured that all of the printed products 4 assume the correct position or orientation in the compartments or buckets 2, that is to say, bear at their leading product edges 4a at the floor or base 2a of the associated compartment of bucket 2. In this manner there is fulfilled the preconditions for a subsequent positionally-correct removal or withdrawal of the printed products 4 out of the rotary bucket or fan wheel 1.

During the course of the further rotation of this rotary bucket wheel 1 the printed products 4 bear with their leading edges 4a at the stripper wheel or wheels 6 or equivalent structure, so that they are hindered from participating in a further co-rotation with the rotary bucket wheel 1, and consequently are displaced out of the compartments or buckets 2. Already at the start of this outward displacement or ejection of the printed products 4 the trailing edges 4b come into contact with the belt or band 31 of the acceleration device 30 and are downwardly moved towards the conveyor device 7 by the action of the conveying-active run or path 31a of the belt or band 31. The trailing edge 4b of the corresponding printed product arrives at the sheet metal support device 26 and bears upon the chains 8 and 9, specifically at the region of the deflection wheels 10 and 12, in other words, at the start of the conveying-active run or path 7a of the conveyor or conveying device 7. As soon as the trailing edge 4b comes to bear at the chains 8 and 9 and the support device 26 such is then engaged by a related one of the grippers or gripper elements 18 located at the chains 8 and 9.

As already previously described, these grippers or gripper elements 18 are opened by the opening cams 24 or equivalent structure during the running of the chains 8 and 9 onto the deflection wheels or sprockets 10 and 12. As soon as the chains 8 and 9 run off of the deflection wheels or sprockets 10 and 12 and thus the brackets 20 run off of the opening cams 24, both of the associated grippers or gripper elements 18 close in the aforedescribed manner and fixedly retain the trailing product edge 4b. At the point in time of clamping the trailing product edge 4b by the grippers or gripper elements 18 the corresponding printed product 4 is located at the region of its leading edge 4a still in the related compartment or bucket 2 of the rotary bucket wheel 1. As a result, the engaged or seized printed product 4 still bears by means of its leading product edge 4a at the stripper wheel or wheels 6, as the same has been shown in FIG. 1.

After its complete departure out of the associated compartment or bucket 2 the printed product 4, which is fixedly held or retained by the grippers 18 at the region of its trailing product edge 4a, comes to bear completely upon the preceding or leading printed product 4. The printed products 4 which are removed in this manner from the rotary bucket wheel 1 are delivered in superimposed orientation as a shingled or imbricated product formation or array by the conveyor device 7 to the downstream located outfeeder or delivery conveyor 28. The release of the printed product 4 occurs upon run-on of the bracket or strap member 20 upon the opening cams 25 which, as heretofore described, cause a lifting of the gripper tongues 19 from the counter surfaces 21a. Each of the printed products 4 which have been released from engagement with the associated grippers or gripper elements 18 are then outfed by the outfeeder or delivery conveyor 28.

Within the outfed shingled or imbricated product formation S the printed products 4 exhibit the same mutual spacing or pitch a, the so-called imbrication spacing or pitch, which is governed by the spacing between successive grippers or gripper elements 18. This imbrication pitch or spacing a is greater than the spacing $a_1$ between the leading edges 4a bearing against the stripper wheel or wheels 6 of the successive printed products 4, as such has been indicated in FIG. 1. The grippers or gripper elements 18 which are guided about the deflection wheels or sprockets 10 and 12 overtake the printed products 4, so that there is ensured that the printed products 4 will be positively seized or engaged at their trailing edges 4b as long as they are still in contact at their leading edges 4a with the stripper wheel or wheels 6 or the like. The printed products 4 are thus completely introduced into the grippers or gripper elements 18 before such close. The printed products 4 can thus not be shifted in their position or only to a slight extent prior to the engagement or seizing thereof by the grippers or gripper elements 18, which renders possible the retention of a regular or uniform imbrication pitch or spacing a.

It is of advantage if the support arrangement which is defined by the two chains 8 and 9 and the intermediately situated sheet metal support device 26 has a lesser width than that of the printed products 4. Consequently, it is not possible for any air cushion to form between the printed products 4 which are downwardly accelerated by the acceleration device 30 and such support arrangement and which air cushion otherwise might hinder the introduction of the trailing product edge 4b into the operative or effective region of the related grippers or gripper elements 18. Additionally, the printed products 4, upon arrival at the chains or chain members 8 and 9, are flexed or bent in a saddle-shaped configuration, which contributes to their product stability.

In the event that by virtue of the construction of the printing machine it is ensured that the printed products 4 which drop into the compartments or buckets 2 of the rotary bucket wheel 1 readily and always assume the correct product position therein, that is to say, bear with their leading product edge 4a completely at the floor or base 2a of the related compartment or bucket 2, then it is possible to dispense with the use of the product aligning or alignment device 39.

For certain fields of application it is also conceivable to omit the product acceleration device 30 which serves, as previously explained, to positively bring the trailing edges 4b of the printed products 4 under all operating conditions, in other words, both at low as well as at high operating or working speeds, with certainty into the operative or effective region of the grippers or gripper elements 18.

Figure 5:
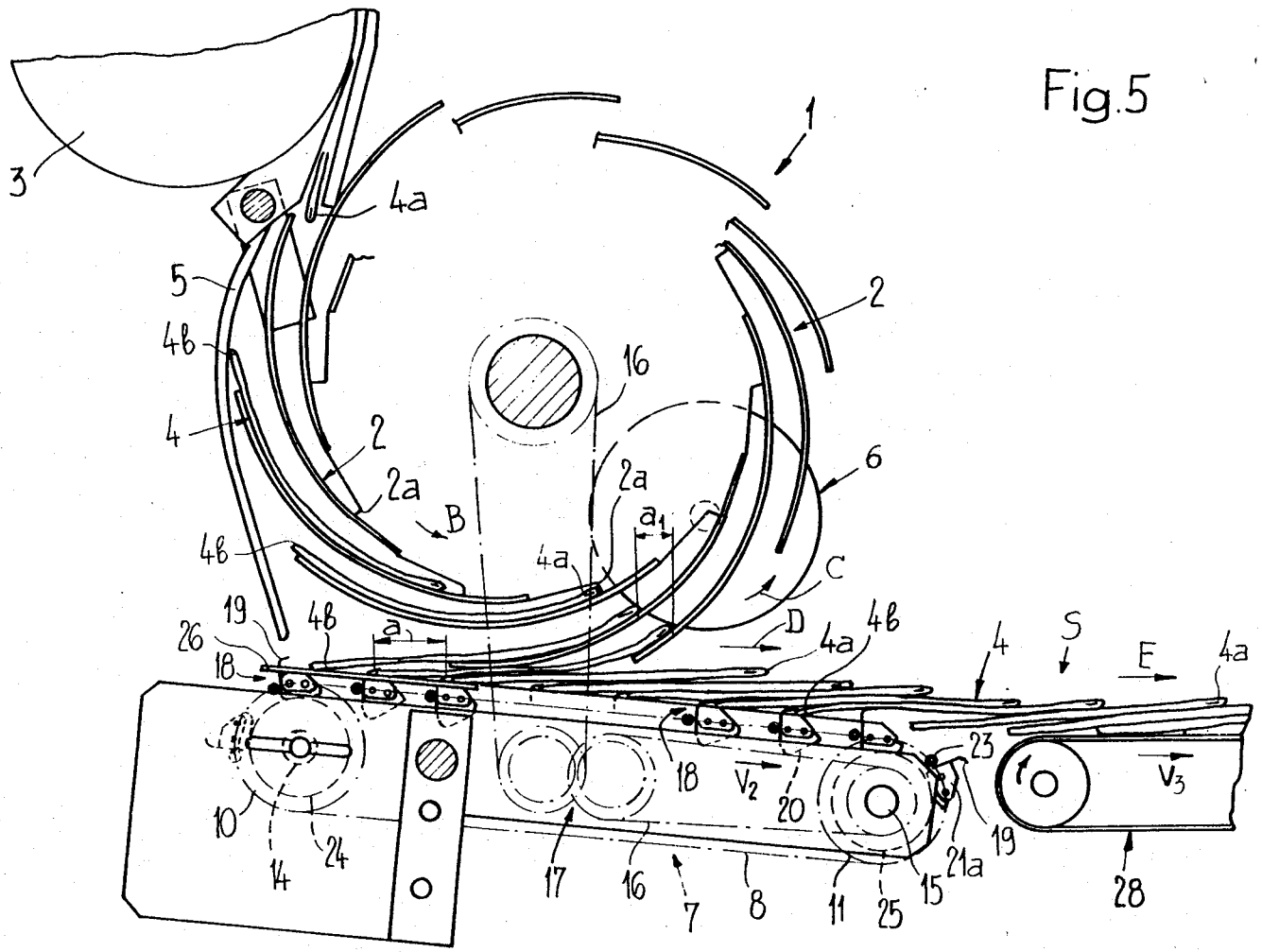
FIG. 5 is a schematic illustration, similar to the showing of FIG. 1, of a second exemplary embodiment of apparatus for receiving or taking over and cutfeeding or delivering the printed products ejected or received from a revolvingly driven or rotary bucket or fan wheel of a printing machine.

Finally, in FIG. 5 there is depicted a modified embodiment which is designed to work without any acceleration device 30 and without any aligning or alignment device 39. It will also be understood that in this modified construction of apparatus as depicted in FIG. 5 there have been generally used the same reference characters to denote the same or analogous components as heretofore considered and described with respect to the first described embodiment of FIGS. 1 to 4. The mode of operation of the apparatus depicted in FIG. 5 otherwise corresponds to the apparatus described previously with reference to FIGS. 1 to 4.

The driving of the chains or chain members 8 and 9 from the rotary bucket or fan wheel 1 through the agency of the drive connection or connection means 16, 16', 17 results in a rigid coupling between the rotational movement of the rotary bucket wheel 1 and the revolving motion of the grippers or gripper elements 18. There is therefore not needed any special cycle-and phase control or a cycle-and phase correction during the operation of the apparatus. However, it would be of course obvious to modify this system such that the chains or chain members 8 and 9 are not driven by the rotary bucket or fan wheel 1, rather by means of a separate drive device.

The opening of the grippers or gripper elements 18 during the deflection or turning of the chains 8 and 9 by means of the deflection wheels or sprockets 10 to 13 results in a particularly simple and spatially compact construction, since in addition to the deflection wheels of sprockets 10 to 13 there are not required any opening dogs or cams or the like which would require a certain amount of space. Here also it is of course obvious that the grippers or gripper elements 18 could be opened, if desired, by the provision of such additional opening elements.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of receiving printed products, especially folded printed products, each having a leading edge and a trailing edge, from a revolvingly driven bucket wheel having compartments of a printing machine, comprising the steps of:

transferring the printed products out of the compartments of the revolvingly driven bucket wheel which rotates in a predeterminate rotational direction;

during said step of transferring said printed products out of said compartments of said revolvingly driven bucket wheel, fixedly retaining each printed product at a trailing edge of the printed product viewed with respect to the predeterminate direction of rotation of the revolvingly driven bucket wheel while the product is still partially within the bucket wheel;

placing the products in an imbricated product formation upon one another ; and outfeeding the imbricated product formation.

2. The method as defined in claim 1, further including the steps of:

engaging the printed products at their trailing edges by means of grippers moved along a closed path of travel substantially in synchronism with the revolvingly driven bucket wheel; and accelerating the trailing edges of the printed products at the start of transfer out of the compartments of the revolvingly driven bucket wheel by means of an acceleration device and downwardly into an effective region of the grippers which are moved in synchronism with the revolvingly driven bucket wheel.

3. The method as defined in claim 2, further including the steps of:

prior to the start of the transfer and the engagement of each of the printed products by the grippers stuffing each printed product into a related compartment of the revolvingly driven bucket wheel by means of an alignment device which engages at the region of the trailing product edge.

4. The method as defined in claim 3, wherein:

each product is stuffed into the related compartment of the revolvingly driven bucket wheel until coming into contact with a floor of such related compartment.

5. The method as defined in claim 1, further including the steps of:

prior to the transfer and the engagement of each of the printed products by the grippers stuffing each printed product into a related compartment of the revolvingly driven bucket wheel by means of an alignment device which engages at the region of the trailing product edge.

6. The method as defined in claim 5, wherein:

each product is stuffed into the related compartment of the revolvingly driven bucket wheel until coming into contact with a floor of such related compartment.

7. The method as defined in claim 1, wherein:

during said step of placing the products in said imbricated formation upon one another the products are still fixedly retained at the trailing edges.

8. An apparatus for receiving printed products, especially folded printed products each having a leading edge and a trailing edge, comprising:

a revolvingly driven bucket wheel rotating in a predeterminate direction of rotation;

a conveyor device positioned to cooperate with said revolvingly driven bucket wheel;

said bucket wheel being provided with compartments;

each of said compartments receiving therein at least one printed product;

gripper elements provided for said conveyor device;

said gripper elements serving for the retention of an edge of the printed products during their departure out of the compartments of the revolvingly driven bucket wheel; and said gripper elements being located relative to the bucket wheel for fixedly retaining each of the printed products at a trailing edge thereof viewed with respect to the predeterminate direction of rotation of the revolvingly driven bucket wheel at least during said departure out of its associated compartment of said revolvingly driven bucket wheel while the product is still partially within the bucket wheel.

9. The apparatus as defined in claim 8, wherein:

said conveyor device is arranged beneath said revolvingly driven bucket wheel; and said gripper elements of said conveyor device revolvingly travelling along a closed path of travel.

10. The apparatus as defined in claim 9, wherein:

said conveyor device has a predeterminate conveying direction; and said predeterminate conveying direction of said conveyor device being in the same sense as the predeterminate direction of rotation of the revolvingly driven bucket wheel.

11. The apparatus as defined in claim 8, wherein:

said conveyor device has a predeterminate conveying direction; and said predeterminate conveying direction of said conveyor device being in the same sense as the predeterminate direction of rotation of the revolvingly driven bucket wheel.

12. The apparatus as defined in claim 11, wherein:

said conveyor device comprises at least one traction element;

deflection wheels at which there is guided said at least one traction element; and said gripper elements being secured at a predeterminate mutual spacing from one another at said traction element.

13. The apparatus as defined in claim 12, wherein:

said at least one traction element comprises at least one chain.

14. The apparatus as defined in claim 10, further including:

support means for the printed products; and said support means extending in said predeterminate conveying direction of the conveyor device.

15. The apparatus as defined in claim 14, wherein:

said support means has a width which is less than the width of the printed products.

16. The apparatus as defined in claim 12, wherein:

said deflection wheels define a conveying-active run for said at least one traction element;

actuation means for actuating said gripper elements; and said actuation means being arranged coaxially with respect to said deflection wheels.

17. The apparatus as defined in claim 16, wherein:

said actuation means comprise actuation elements for opening said gripper elements.

18. The apparatus as defined in claim 16, wherein:

said actuation means comprise actuation cams secured to associated ones of the deflection wheels.

19. The apparatus as defined in claim 18, wherein:

said actuation cams are structured as hub means of said deflections wheels.

20. The apparatus as defined in claim 8, wherein:

each of said gripper elements comprise a gripper tongue and a counter support;

said gripper tongue being pressed by spring force against the associated counter support; and said gripper tongue being raised from the associated counter support for opening the gripper element.

21. The apparatus as defined in claim 12, further including:

said deflection wheels define a conveying-active run for said at least one traction element;

actuation means for actuating said gripper elements;

said actuation means being arranged coaxially with respect to said deflection wheels;

each gripper element comprising a gripper tongue which forms part of a bracket means formed of a spring-elastic material; and each gripper tongue upon running onto an associated actuation means is spring-elastically deflected.

22. The apparatus as defined in claim 12, where-in:

said conveyor device comprises two traction elements arranged in substantially parallel and mutually spaced relationship with respect to one another;

each of said traction elements being provided with said gripper elements; and support means for the printed products arranged between said traction elements.

23. The apparatus as defined in claim 8, further including:

an acceleration device engaging at a trailing edge of a printed product which is in the incipient stage of being ejected out of an associated compartment of the revolvingly driven bucket wheel; and said acceleration device serving for accelerating the trailing edge of the product downwardly into an effective region of the gripper elements.

24. The apparatus as defined in claim 23, wherein:

said conveyor device has a predeterminate direction of conveying; and said acceleration device comprises at least one endless revolvingly driven acceleration element having an active path which extends transverse to the predeterminate direction of conveying of the conveyor device.

25. The apparatus as defined in claim 24, wherein:

said acceleration element comprises a belt.

26. The apparatus as defined in claim 24, wherein:

said conveyor device has a conveying-active run;

said predeterminate conveying direction of said conveyor device being in the same sense as the predeterminate direction of rotation of the revolvingly driven bucket wheel; and the active path of the acceleration element is arranged at the region of the deflection wheels at a starting portion of the conveying-active run of the conveyor device.

27. The apparatus as defined in claim 8, further including:

an aligning device for displacing the printed products into the compartments of the revolvingly driven bucket wheel; and said aligning device engaging at the trailing edges of the printed products prior to engagement of the printed products by the gripper elements.

28. The apparatus as defined in claim 27, wherein:

each of the compartments of the revolvingly driven bucket wheel has a floor; and said aligning device displacing each of the printed products into an associated one of the compartments of the revolvingly driven bucket wheel until coming into contact with the floor of the associated compartment.

29. The apparatus as defined in claim 27, wherein:

said aligning device comprises at least one endless revolvingly driven alignment element; and said alignment element having an active run which extends approximately tangentially with respect to the revolvingly driven bucket wheel.

30. The apparatus as defined in claim 29, wherein:

said alignment element comprises an alignment belt.

31. The apparatus as defined in claim 29, wherein:

said revolvingly driven bucket wheel has a predeterminate rotational velocity;

said aligning element has a predeterminate revolving velocity; and the revolving velocity of the aligning element being greater than the rotational velocity of the revolvingly driven bucket wheel.

32. The apparatus as defined in claim 29, further including:

support means for the printed products;

said support means having a width which is less than the width of the printed products;

said conveyor device comprises at least one traction element;

deflection wheels at which there is guided said at least one traction element;

said gripper elements being secured at a predeterminate mutual spacing from one another at said traction element;

said deflection wheels define a conveying-active run for said at least one traction element;

actuation means for actuating said gripper elements;

said actuation means being arranged coaxially with respect to said deflection wheels;

said at least one endless revolvingly driven aligning element comprises two said aligning elements arranged in substantially mutually parallel relationship with respect to one another; and an acceleration element arranged between said two aligning elements.

33. The apparatus as defined in claim 8, wherein:

said gripper elements are carried by the conveyor device; and said gripper elements fixedly retaining the trailing edges of the printed products during departure of the printed products out of the compartments of the bucket wheel and during placement of the printed products in imbricated formation upon the conveyor device and during conveyance of the imbricated formation upon the conveyor device.

* * * * *